US009341001B2

(12) United States Patent
Baptiste et al.

(10) Patent No.: US 9,341,001 B2
(45) Date of Patent: May 17, 2016

(54) INVENTORY CONTROL SYSTEM

(71) Applicant: Robert Baptiste, Alamo, CA (US)

(72) Inventors: Robert Baptiste, Alamo, CA (US); Thomas Geraty, San Jose, CA (US); Mark Brinkerhoff, San Jose, CA (US); Wade Barnett, San Jose, CA (US)

(73) Assignees: Robert Baptiste, Alamo, CA (US); Mathew Baptiste, Alamo, CA (US)

( * ) Notice: Subject to any disclaimer, the term of this patent is extended or adjusted under 35 U.S.C. 154(b) by 191 days.

(21) Appl. No.: 13/857,971

(22) Filed: Apr. 5, 2013

(65) Prior Publication Data

US 2013/0264917 A1 Oct. 10, 2013

Related U.S. Application Data

(60) Provisional application No. 61/620,892, filed on Apr. 5, 2012, provisional application No. 61/760,609, filed on Feb. 4, 2013.

(51) Int. Cl.

| | |
|---|---|
| ***E05B 65/46*** | (2006.01) |
| ***A47B 88/04*** | (2006.01) |
| ***A47F 1/12*** | (2006.01) |
| ***A47F 3/00*** | (2006.01) |
| *E05B 47/00* | (2006.01) |
| *A47F 5/00* | (2006.01) |

(52) U.S. Cl.

CPC ..... *E05B 65/462* (2013.01); *A47B 88/04* (2013.01); *A47F 1/126* (2013.01); *A47F 3/002* (2013.01); *A47F 5/0043* (2013.01); *E05B 47/0004* (2013.01); *E05B 65/463* (2013.01); *Y10T 29/49826* (2015.01)

(58) Field of Classification Search

USPC ..... 221/123–125, 151–154

See application file for complete search history.

(56) References Cited

U.S. PATENT DOCUMENTS

| | | | | |
|---|---|---|---|---|
| 3,102,663 | A * | 9/1963 | Albright | G07F 11/16 221/131 |
| 4,200,201 | A | 4/1980 | Collins | |
| 4,887,737 | A | 12/1989 | Adenau | |
| 7,451,881 | B2 | 11/2008 | Hardy | |
| 7,641,072 | B1 | 1/2010 | Vlastakis | |
| 7,828,158 | B2 | 11/2010 | Colelli | |
| 7,980,398 | B2 | 7/2011 | Kahl | |
| 8,047,385 | B2 | 11/2011 | Hardy | |
| 8,123,071 | B2 * | 2/2012 | Fitzgerald | B65G 1/04 221/124 |

(Continued)

FOREIGN PATENT DOCUMENTS

WO 2011094805 A1 8/2011

OTHER PUBLICATIONS

International Search Report and Written Opinion issued on Jul. 9, 2013, in related PCT/US13/35528 application.

*Primary Examiner* — Gene Crawford
*Assistant Examiner* — Kelvin L Randall, Jr.
(74) *Attorney, Agent, or Firm* — Jeffer Mangels Butler & Mitchell LLP; Brennan C. Swain, Esq.

(57) ABSTRACT

An inventory control system comprising a dispensing module; a horizontal blocking bar proximate the front portion of the dispensing module; a dispensing module sliding base comprising having a roll pin affixed thereto, and a right side wall having a roll pin affixed thereto; a left rocker arm and a right rocker arm each having a slot; and wherein the roll pin of the left side wall passes through the slot of the left rocker arm and the roll pin of the right side wall passes through the slot of the right rocker arm.

8 Claims, 13 Drawing Sheets

(56) References Cited

U.S. PATENT DOCUMENTS

| | | | | |
|---|---|---|---|---|
| 2004/0140278 | A1 | 7/2004 | Mueller | |
| 2005/0189369 | A1 | 9/2005 | Vlastakis | |
| 2006/0237381 | A1 | 10/2006 | Lockwood | |
| 2006/0266762 | A1 | 11/2006 | Andrews | |
| 2008/0237159 | A1 | 10/2008 | Bray | |
| 2009/0184130 | A1* | 7/2009 | Miller | A47F 1/126 221/279 |
| 2009/0242582 | A1 | 10/2009 | Vlastakis | |
| 2010/0017025 | A1 | 1/2010 | Lockwood | |
| 2010/0059469 | A1 | 3/2010 | Mason | |
| 2011/0017763 | A1 | 1/2011 | Colelli | |
| 2011/0087369 | A1 | 4/2011 | Bauer | |
| 2011/0094975 | A1 | 4/2011 | Hardy | |
| 2011/0163113 | A1 | 7/2011 | Grubbs | |
| 2011/0220597 | A1 | 9/2011 | Sherretts | |
| 2012/0000869 | A1 | 1/2012 | Hardy | |
| 2012/0055892 | A1 | 3/2012 | Hardy | |

* cited by examiner

INVENTORY CONTROL SYSTEM

CROSS REFERENCE TO RELATED APPLICATIONS

This application claims the benefit of U.S. Provisional Patent Application No. 61/620,892, filed on Apr. 5, 2012, and U.S. Provisional Patent Application No. 61/760,609, filed on Feb. 4, 2013, the entireties of which are incorporated herein by reference.

FIELD OF THE INVENTION

The present invention relates generally to inventory control systems, more particularly, to an inventory control system that includes theft deterrence.

BACKGROUND OF THE INVENTION

Billions of dollars worth of merchandise are stolen each year from retailers. This is often referred to as shrink. Shrink represents approximately 42 billion dollars in retail loss in the U.S. and is statistically rising. Accordingly, loss prevention is becoming an increasing (priority for companies. The top two sources of shrink are internal merchandise theft and individual customer merchandise theft. The top two shrink item categories are razor blades and skin care/cosmetic products. Shelf sweeping is a particular part of the shrink problem. Shelf sweeping occurs when individuals or groups remove all the shelf stock and exit the store, similar to a "smash and grab" shoplifting technique. Shelf sweeping relies on excessive quantities of product being available on the shelf. The fact that shrink is rising shows that the current solutions are not effective enough.

Accordingly, a need exists for an inventory control system that helps solve the problems discussed above.

SUMMARY OF THE PREFERRED EMBODIMENTS

In accordance with a preferred embodiment of the present invention there is provided an inventory control system comprising a drawer that includes one or more dispensing modules, the one or more dispensing modules each comprising a front portion and a rear portion; a horizontal sliding bar positioned proximate the rear portion of the one or more dispensing modules, the horizontal sliding bar comprising one or more slots; and a horizontal blocking bar positioned proximate the front portion of the one or more dispensing modules, the horizontal blocking bar having a left side and a right side. Each of the one or more dispensing modules further comprises a dispensing module sliding base, and the dispensing module sliding base comprises a front portion, a rear portion, a left side wall, and a right side wall. The dispensing module sliding base further comprises an extension tab affixed proximate the rear portion of the dispensing module sliding base, and the extension tab comprises a first roll pin affixed thereto. The first roll pin is positioned proximate the one or more curved slots of the horizontal sliding bar. The left side wall of the dispensing module sliding base comprises a second roll pin affixed thereto, and the right side wall of the dispensing module sliding base comprises a third roll pin affixed thereto. Each of the one or more dispensing modules further comprises a left rocker arm and a right rocker arm, and the left rocker arm and the right rocker arm each comprises a front portion, a rear portion, and a curved slot. The left rocker arm is positioned adjacent the outside of the left side wall of the dispensing module such that the second pin of the left side wall of the dispensing module passes through the curved slot of the left rocker arm. The right rocker arm is positioned adjacent the outside of the right side wall of the dispensing module such that the third roll pin of the right side wall of the dispensing module passes through the curved slot of the right rocker arm. The horizontal blocking bar is connected between the left rocker arm and the right rocker arm. The left side of the horizontal blocking bar is connected proximate the front portion of the left rocker arm, and the right side of the horizontal blocking bar is connected proximate the front portion of the right rocker arm. Preferably, a shield is affixed to the horizontal blocking bar. Preferably, an electromagnet is affixed proximate the horizontal sliding bar. Preferably, an elastic member is affixed proximate the dispensing module sliding base. Preferably, the one or more slots of the horizontal sliding bar comprise a portion that is angled between about 30 and 60 degrees. Preferably, at least one solenoid is affixed proximate the horizontal sliding bar. Preferably, the at least one solenoid includes a retractable pin capable of retracting and extending, the retractable pin engaging with the dispensing module sliding base. Preferably, the retraction and extension of the retractable pin is controlled by a microprocessor.

In accordance with another preferred embodiment of the present invention there is provided a method of controlling product inventory using a dispensing module, the dispensing module comprising a front portion and a rear portion; a horizontal blocking bar positioned proximate the front portion of the dispensing module; a dispensing module sliding base, the dispensing module sliding base comprising a front portion and a rear portion, a left side wall having a roll pin affixed thereto, and aright side wall having a roll pin affixed thereto; a left rocker arm and a right rocker arm, each having a front portion and a rear portion and each having a slot, the roll pin of the left side wall passing through the slot of the left rocker arm and the roll pin of the right side wall passing through the slot of the right rocker arm; the method comprising pressing the front portion of the dispensing module sliding base; moving the left rocker arm about the roll pin of the left side wall and moving the right rocker arm about the roll pin of the right side wall such that the front portions of each of the left rocker arm and the right rocker arm move to a lower position; and lowering the horizontal blocking bar. Preferably, the dispensing module further comprises a horizontal sliding bar positioned proximate the rear portion of the dispensing module, the horizontal sliding bar comprises one or more slots, the dispensing module sliding base further comprises an extension tab that has a roll pin affixed thereto, and the method further comprises moving the horizontal sliding bar about the roll pin of the extension tab and locking the horizontal blocking bar in a lowered position. Preferably, the dispensing module further comprises at least one microprocessor connected to at least one solenoid, the at least one solenoid includes a retractable pin capable of retracting and extending, the retractable pin engages with the dispensing module base, and the method further comprises controlling the retraction and extension of the retractable pin using the microprocessor.

In accordance with another preferred embodiment of the present invention there is provided an inventory control system comprising a dispensing module, the dispensing module comprising a front portion and a rear portion; a horizontal blocking bar positioned proximate the front portion of the dispensing module; a dispensing module sliding base, the dispensing module sliding base comprising a front portion, a rear portion, a left side wall having a roll pin affixed thereto, and aright side wall having a roll pin affixed thereto; a left rocker arm and a right rocker arm, each having a front portion and a rear portion and each having a slot; and wherein the roll pin of the left side wall passes through the slot of the left rocker arm and the roll pin of the right side wall passes through the slot of the right rocker arm. Preferably, each slot of the left rocker arm and the right rocker arm is curved. Preferably, the dispensing module further comprises a horizontal sliding bar positioned proximate the rear portion of the dispensing module. Preferably, the horizontal sliding bar comprises one or more slots. Preferably, the dispensing module sliding base further comprises an extension tab having a roll pin affixed thereto, the roll pin of the extension tab being engaged with the one or more slots of the horizontal sliding bar. Preferably, the dispensing module further comprises at least one microprocessor connected to at least one solenoid. Preferably, the at least one solenoid includes a retractable pin capable of retracting and extending, the retractable pin engaging with the dispensing module sliding base. Preferably, the at least one microprocessor controls the retraction and extension of the retractable pin. Preferably, the inventory control system further comprises an electromagnet and a spring affixed proximate the horizontal sliding bar.

DETAILED DESCRIPTION OF THE PREFERRED EMBODIMENTS

Figure 1:
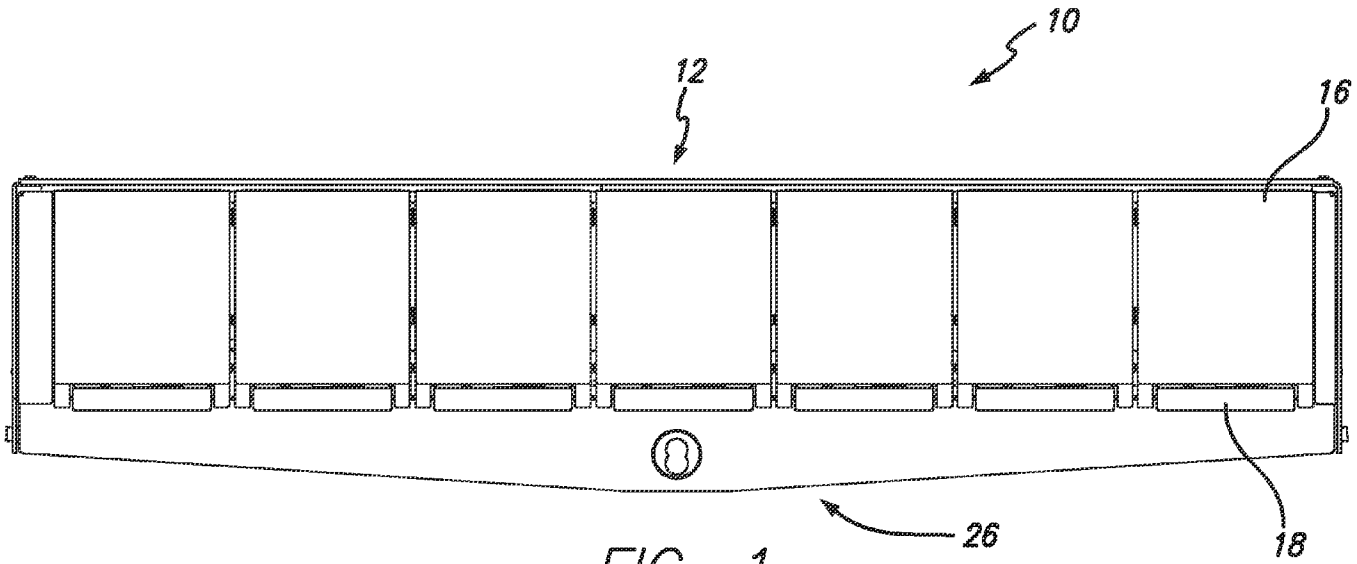
FIG. 1 is a front elevational view of an inventory control system in accordance with a preferred embodiment of the present invention.
Figure 2:
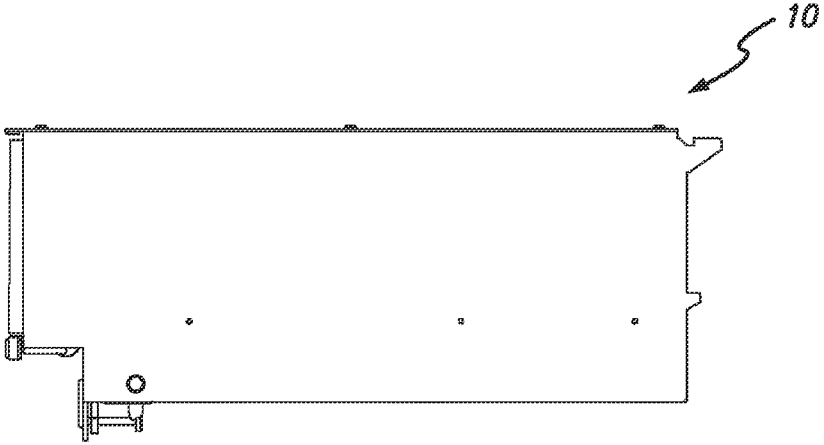
FIG. 2 is a side elevational view of the inventory control system of FIG. 1.

The following description of embodiments of the present invention refers to the accompanying figures. Where appropriate, the same reference numbers in different figures refer to the same or similar elements. The following description and figures are illustrative and are not to be construed as limiting. Numerous specific details are described to provide a thorough understanding of the disclosure. However, in certain instances, well known or conventional details are not described in order to avoid obscuring the description of inventive aspects of the present invention. References to one or an embodiments in the present disclosure can be, but not necessarily are references to the same embodiment; and, such references mean at least one of the embodiments.

Reference in this specification to "one embodiment" or "an embodiment" means that a particular feature, structure, or characteristic described in connection with the embodiment is included in at least one embodiment of the disclosure. The appearances of the phrase "in one embodiment" in various places in the specification are not necessarily all referring to the same embodiment, nor are separate alternative embodiments mutually exclusive of other embodiments. Moreover, various features are described which may be exhibited by some embodiments but not necessarily by others. Similarly, various requirements are described which may be requirements for some embodiments but not other embodiments.

The terms used in this specification generally have their ordinary meanings in the art, within the context of the disclosure, and in the specific context where each term is used. Certain terms that are used to describe the disclosure may be discussed below, or elsewhere in the specification, to provide additional guidance to the practitioner regarding the description of the disclosure. For convenience, certain terms may be highlighted, for example using italics and/or quotation marks; however, the use of highlighting has no influence on the scope and meaning of a term. The scope and meaning of a term is the same, in the same context, whether or not it is highlighted. It will be appreciated that the same thing can be said in more than one way.

Consequently, alternative language and synonyms may be used for any one or more of the terms discussed herein. Nor is any special significance to be placed upon whether or not a term is elaborated or discussed herein. Synonyms for certain terms may be provided. A recital of one or more synonyms does not exclude the use of other synonyms. The use of examples anywhere in this specification, including examples of any terms discussed herein, is illustrative only and is not intended to further limit the scope and meaning of the disclosure or of any exemplified term. Likewise, the disclosure is not limited to various embodiments given in this specification.

Without intent to further limit the scope of the disclosure, examples of instruments, apparatus, methods and their related results according to the embodiments of the present disclosure are given below. Note that titles or subtitles may be used in the examples for convenience of a reader, which in no way should limit the scope of the disclosure. Unless otherwise defined, all technical and scientific terms used herein have the same meaning as commonly understood by one of ordinary skill in the art in the field of the present invention. In the case of conflict, the present document, including definitions, will control.

Referring now to FIGS. 1 through 17, which are for purposes of illustrating the present invention and not for purposes of limiting the same, the accompanying pictures and drawings show various views of the inventory control system 10 and components thereof. Generally, the invention is embodied in a system 10 that includes a plurality of modular enclosures or dispensing modules 12 for securing and dispensing inventory such as disposable razors, batteries, toys, and other consumer products. The system 10 is intended to replace an existing shelving unit in a retail store. The door 16 of each of the dispensing modules 12 within the system 10 can be opened by pressing a button 18, as can be seen in FIG. 11. When the door 16 is opened and tilts forward, a single piece of merchandise is exposed for purchase. As the door 16 opens, a horizontal blocking bar 20 is pivoted downwardly to a lowered position in front of the remaining inventory behind the piece of merchandise being dispensed, as can be seen in FIGS. 9 and 10, such that only one piece of merchandise can be removed. The door 16 can be closed automatically by an adjustable timer after a predetermined period of time has elapsed.

Figure 6:
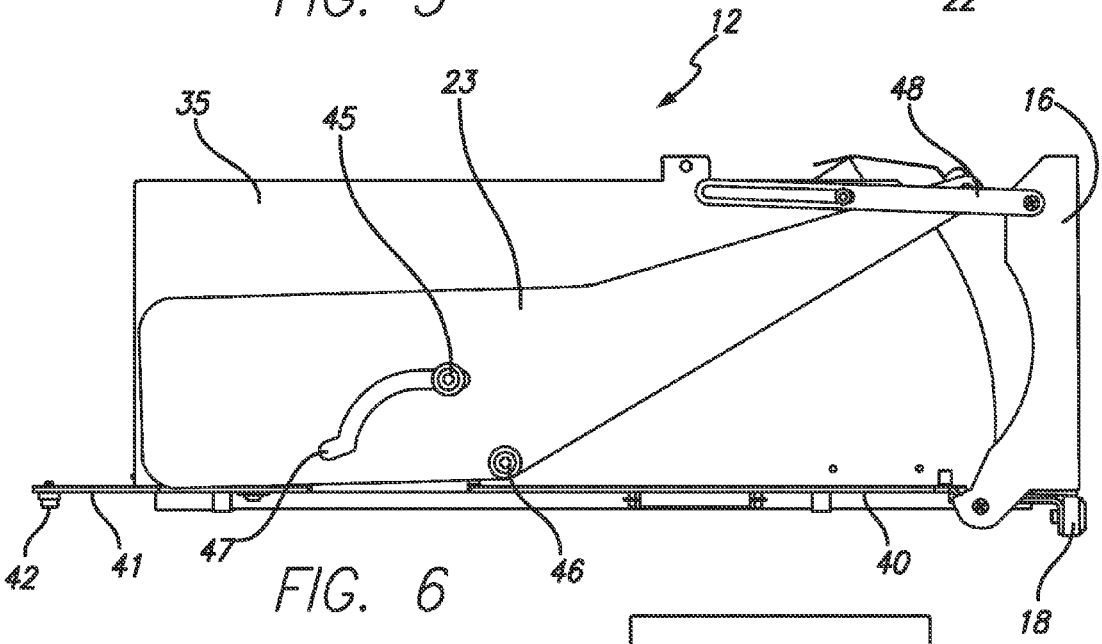
FIG. 6 is a side elevational view of one of the dispensing modules of the inventory control system of FIG. 1.
Figure 7:
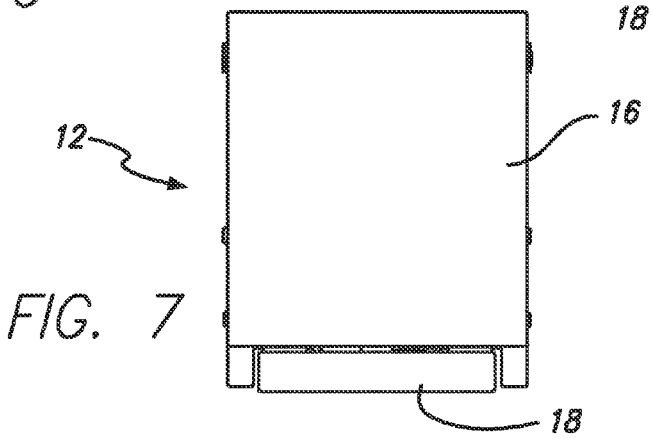
FIG. 7 is a front elevational view of one of the dispensing modules of the inventory control system of FIG. 1.
Figure 8:
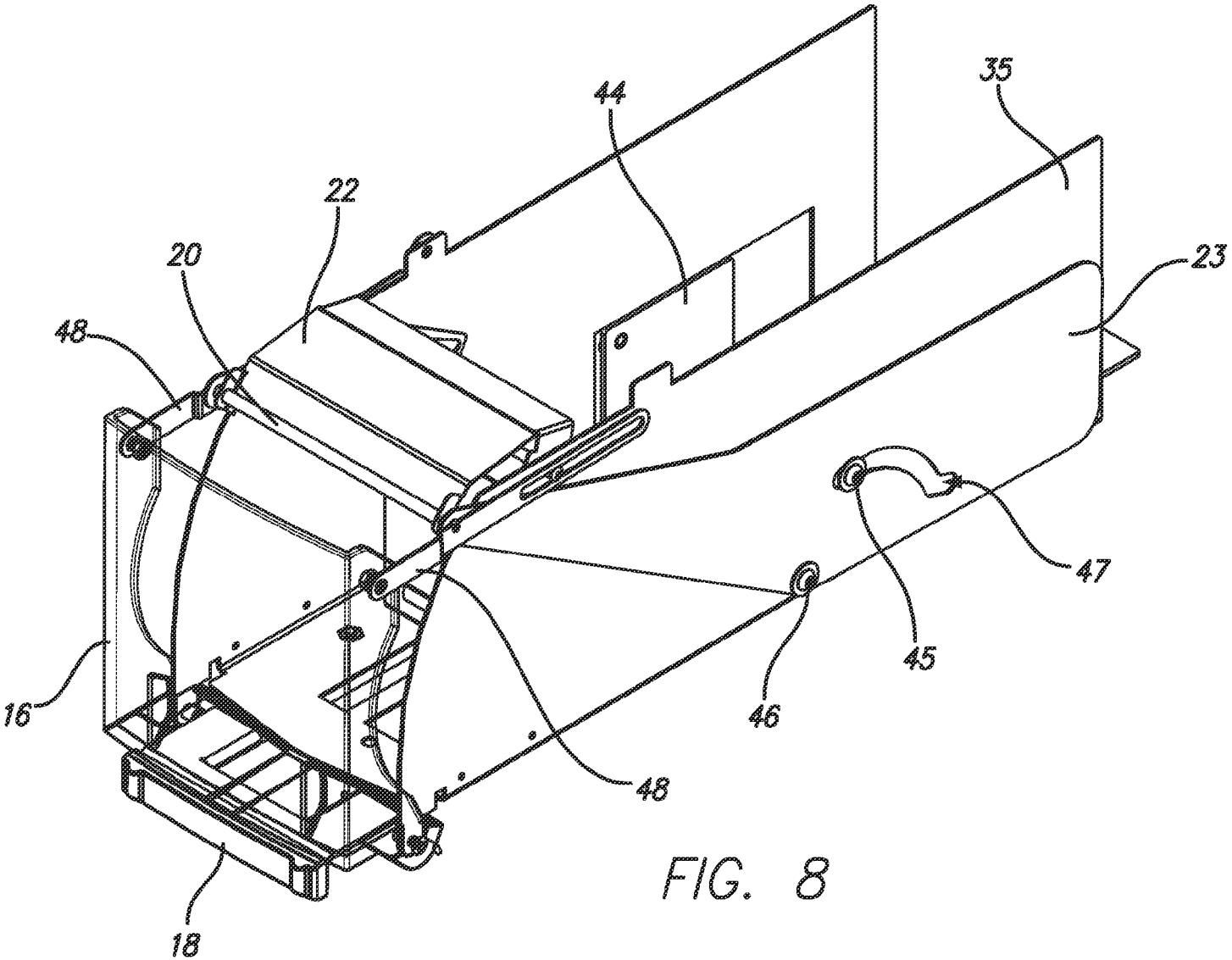
FIG. 8 is a perspective view of one of the dispensing modules of the inventory control system of FIG. 1.
Figure 9:
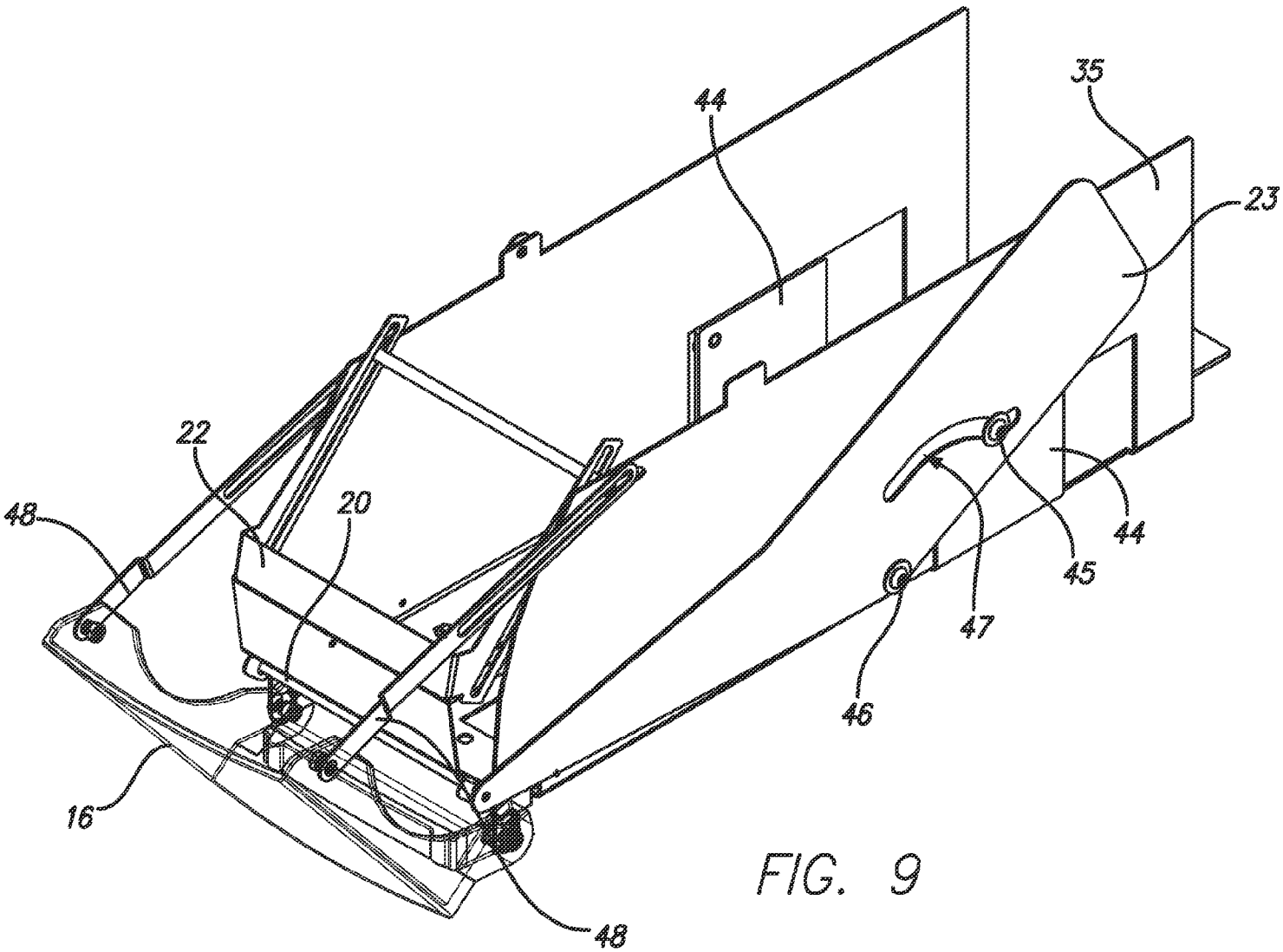
FIG. 9 is a perspective view of one of the dispensing modules of the inventory control system of FIG. 1 in an open state.
Figure 10:
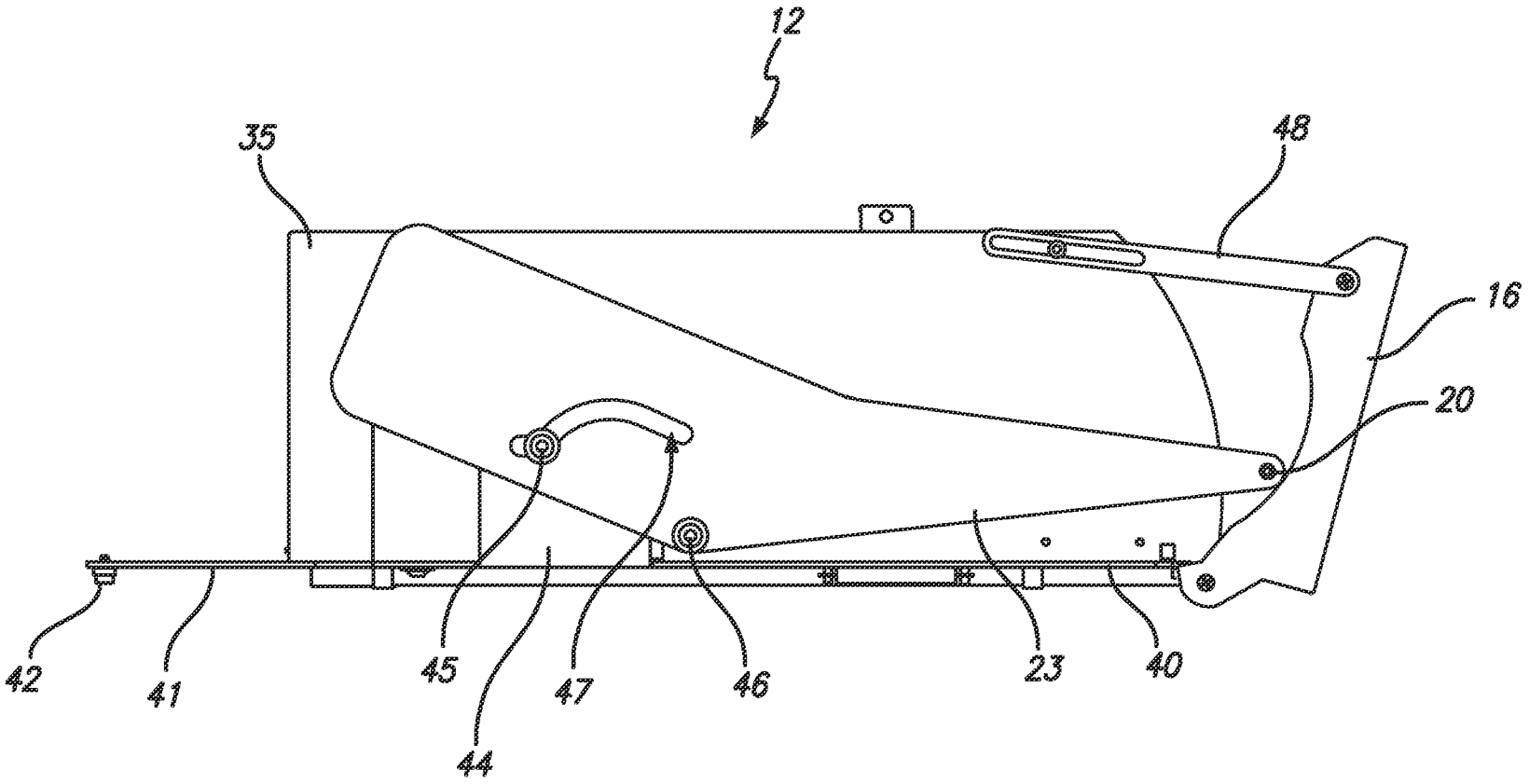
FIG. 10 is a side elevational view of one of the dispensing modules of the inventory control system of FIG. 1 showing the dispensing module in an open state.
Figure 11:
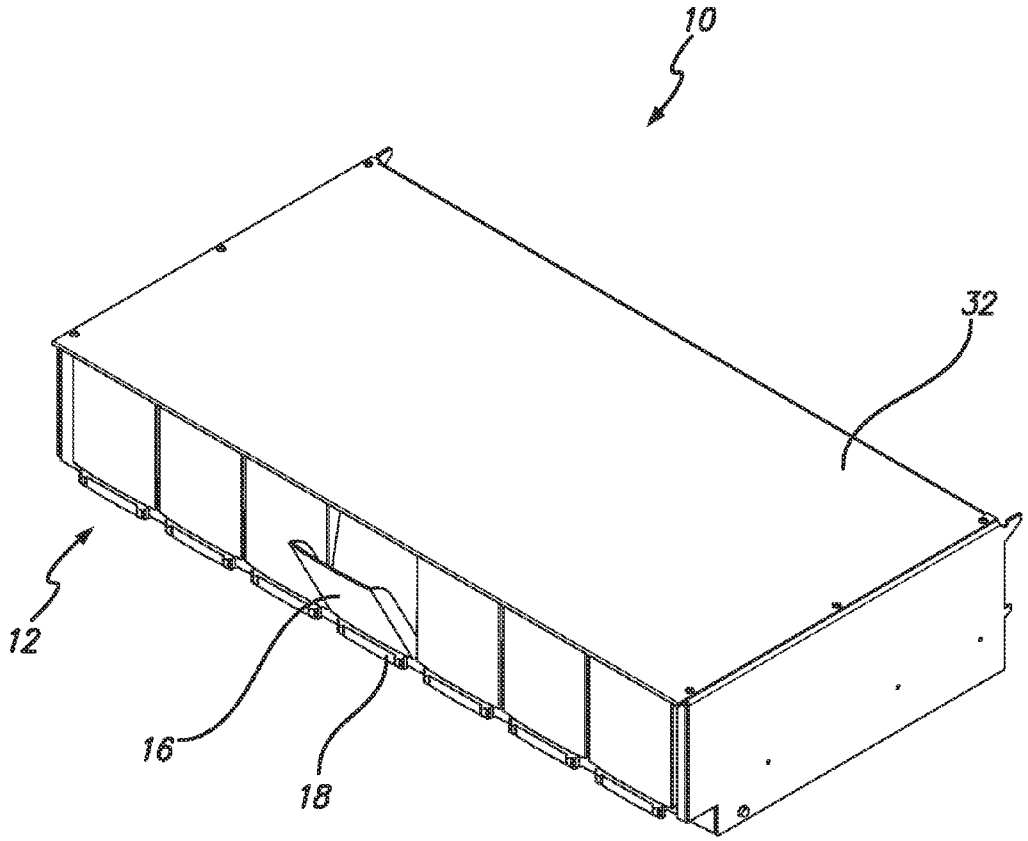
FIG. 11 is a perspective view of the inventory control system of FIG. 1 showing one of the dispensing modules in an open state.
Figure 17:
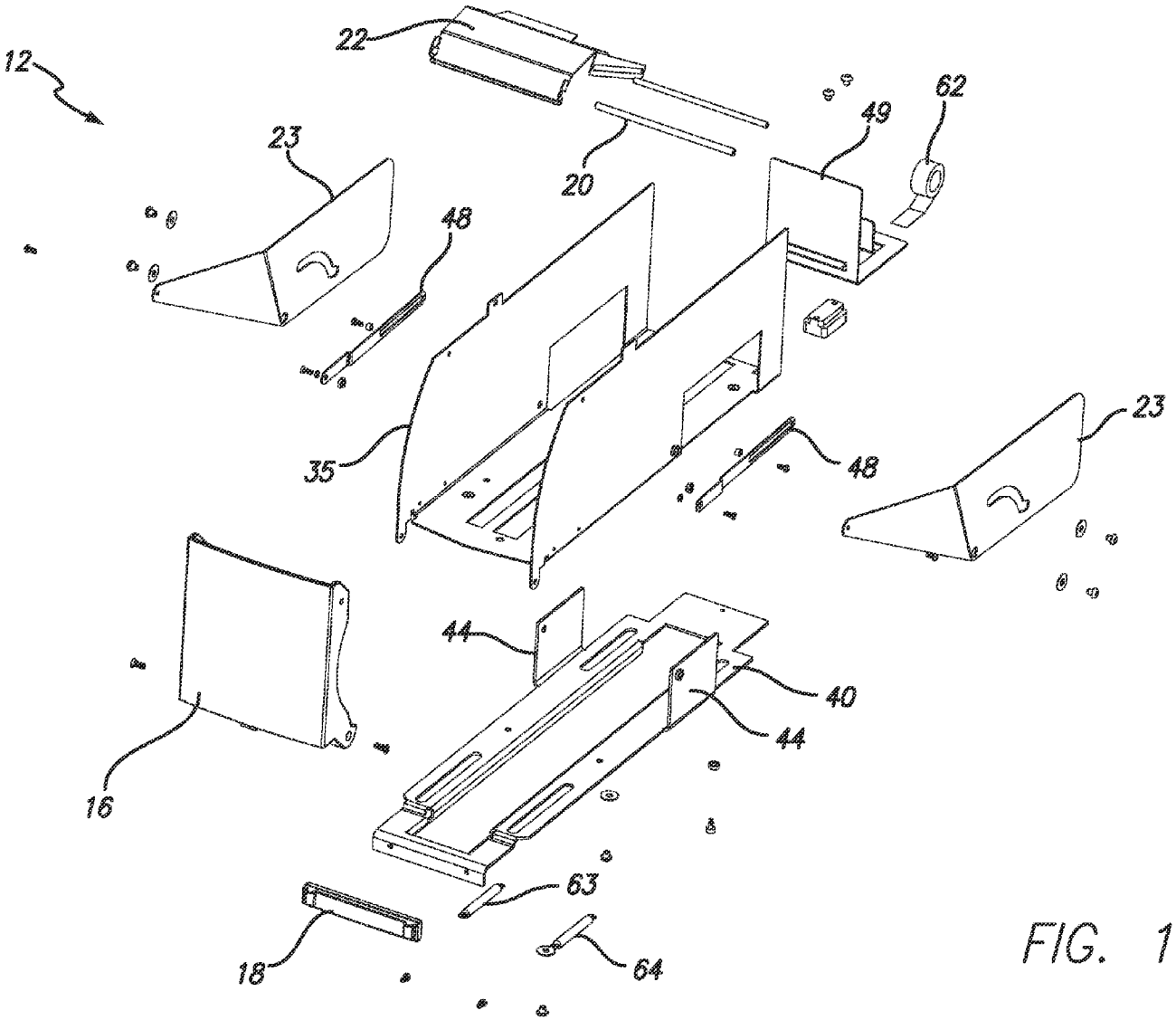
FIG. 17 is an exploded view of one of the dispensing modules of the inventory control system of FIG. 1.

Referring now to FIGS. 5 through 10 and FIG. 17, a single dispensing module 12 is shown. The dispensing module 12 includes a sliding base 40, an extension tab 41 that includes a roll pin 42, left and right rocker arms 23, and horizontal blocking bar 20. The term roll pin as used herein (including in reference to roll pin 42, as well as any other roll pin discussed or described herein), is intended to include and encompass any type of pin, screw, bolt, cylinder, bearing, roll bearing, roller bearing, or any other comparable or similar structure known to those of skill in the art. The sliding base 40 includes left and right side walls 44, each of which includes a roll pin 45 being affixed thereto, and button 18 is mounted at the front portion of the sliding base 40. The dispensing module 12 includes springs 63 and 64, which are engaged with the sliding base 40. Springs 63 and 64 are contemplated to encompass any elastic member known to those of skill in the art. The left and right rocker arms 23 include a slot 47, which may be curved (as shown), straight, or angled, and rocker arms 23 are mounted to the sliding base 40 by way of hinge or pivot point 46. In another preferred embodiment, the horizontal blocking bar 20 may include a shield 22 secured thereto that provides added theft deterrence when the horizontal blocking bar 20 is in the lowered position. It is contemplated and intended to be within the scope of the present invention that shield 22 can be either a flexible or rigid material, and that shield 22 can be composed of any material known to those of skill in the art, including but not limited to metal, plastic, or cloth. Preferably, the horizontal blocking bar 20 is operated by left and right rocker arms 23. In another preferred embodiment, the door 16 may be connected to left and right side arms 48 by one or more hinges, roll pins, or pivot points, as can be seen in FIGS. 6, 8, and 17.

When the button 18 is pressed (or when the front portion of the dispensing module sliding base 40 otherwise is pressed towards the rear of the unit), the sliding base 40 and roll pins 45 move in a rearward direction (i.e., away from door 16), thus causing the front portions of the left and right rocker arms 23 to rotate downwardly, thus causing horizontal blocking bar 20 to move into a lowered position (and preventing the removal of any consumer products located behind the horizontal blocking bar 20), as can be seen in FIGS. 9 and 10 in particular. This action correspondingly stretches or loads springs 63 and 64 and causes door 16 to open. Consumer products that are to be dispensed by system 10 are placed in front of a spring-loaded, horizontally-moveable backstop 49. As the specified quantity of consumer products are removed from the space in front of the horizontal blocking bar 20 when door 16 opens, and after the horizontal blocking bar 20 moves back into an upward position and the door 16 closes (as discussed further below), the backstop 49 advances the remaining product in a forward direction, in the direction of door 16), in an incremental fashion. Backstop 49 is caused to advance in a forward direction through constant force spring 62 (as can be seen in FIG. 17 in particular); however, any spring or elastic member known to those of skill in the art is contemplated any intended to be within the scope of the present invention.

Figure 14:
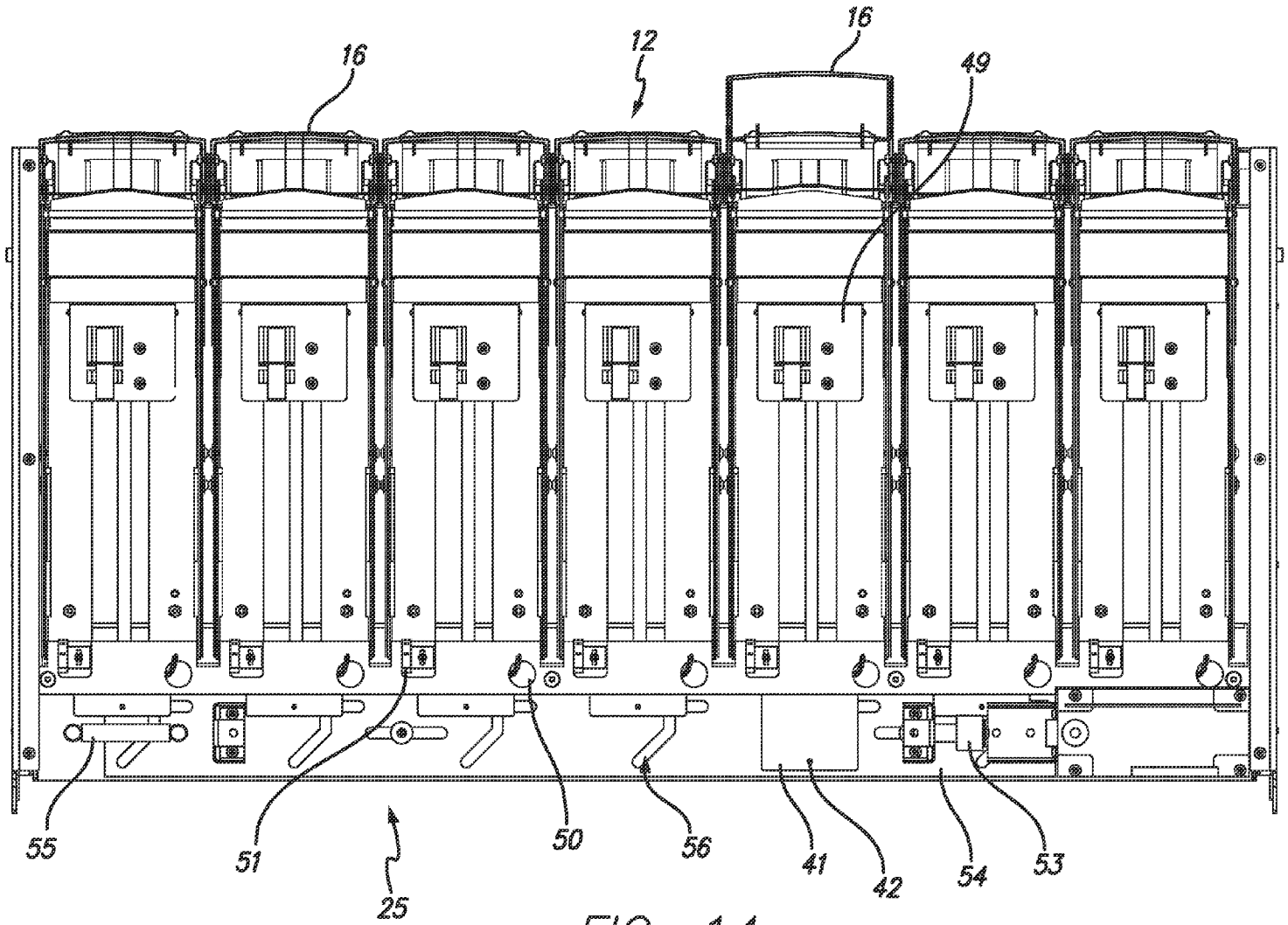
FIG. 14 is a top plan cross-section view of the inventory control system of FIG. 1 showing one of the dispensing modules in an open state.
Figure 15:
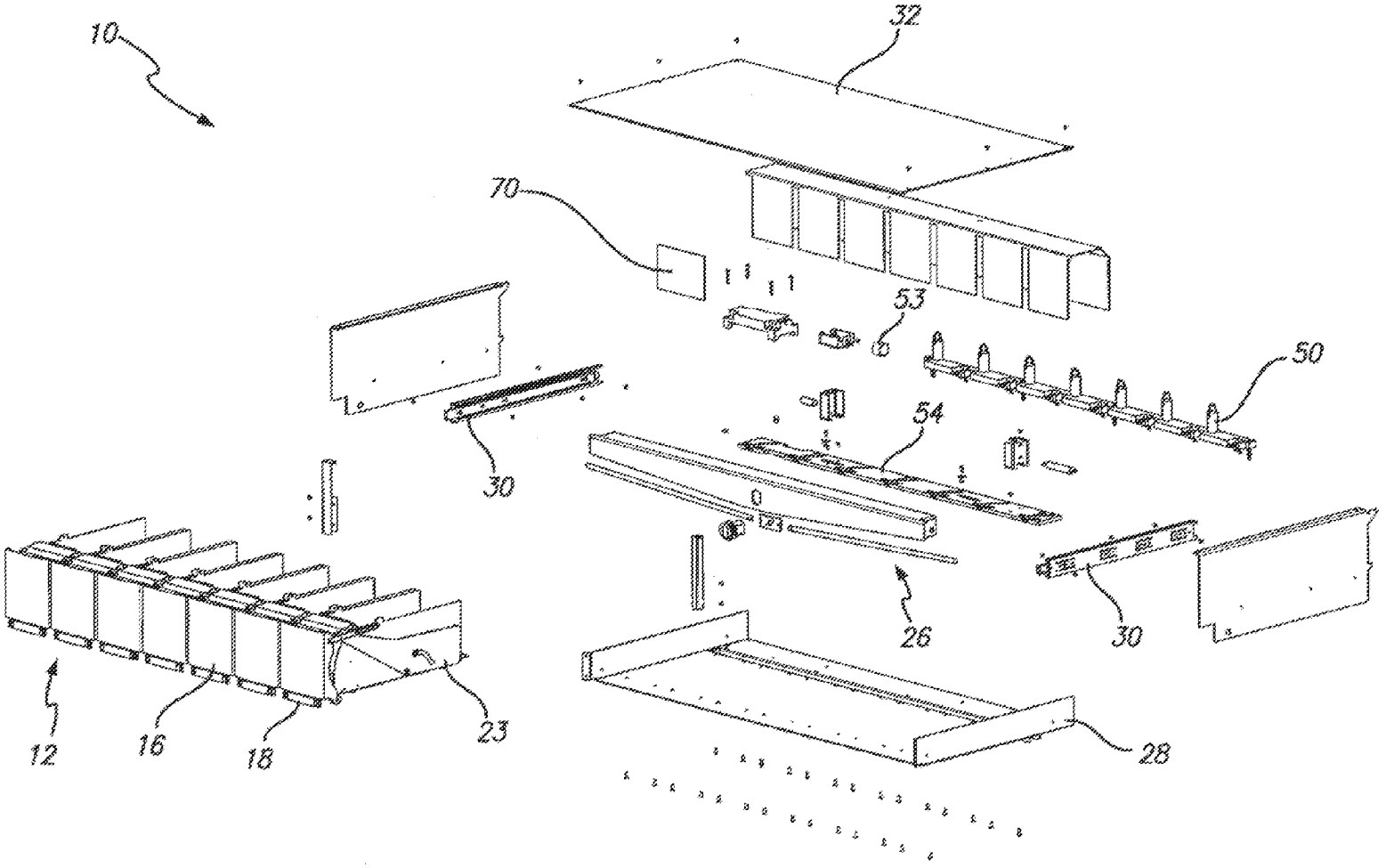
FIG. 15 is an exploded view of the enclosure of the inventory control system of FIG. 1.
Figure 16:
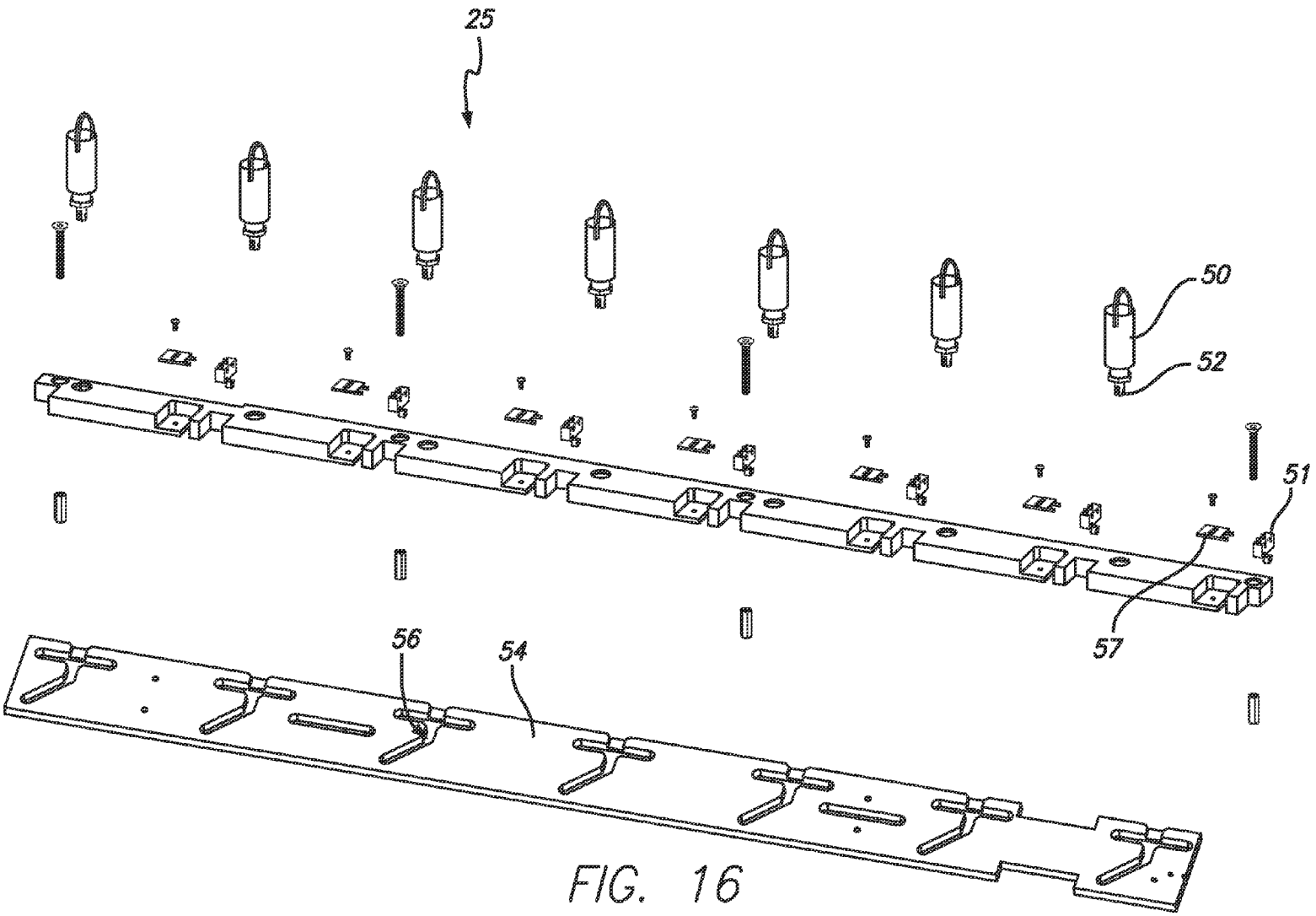
FIG. 16 is an exploded view of a portion of the enclosure of the inventory control system of FIG. 1.

As shown in FIGS. 12 through 16, the system 10 includes a lock-out mechanism 25 that includes a spring or elastic member 55, which works in conjunction with one or more solenoids 50 to prevent other doors 16 from opening while a single door 16 is open, such as, for example, until a timer lapses and the one door closes thus resetting the system and allowing any one of the other doors to open. Multiple solenoids 50, each of which contains a retractable pin 52, as well as multiple microswitches 51 towards the rear portion of each dispensing module 12, as shown in FIGS. 12 through 16. The term retractable pin is intended to include and encompass any type of plunger or pin, or any other comparable structure known to those of skill in the art. The microswitches 51 may be mounted using bracket 57, as shown in FIG. 16.

Figure 12:
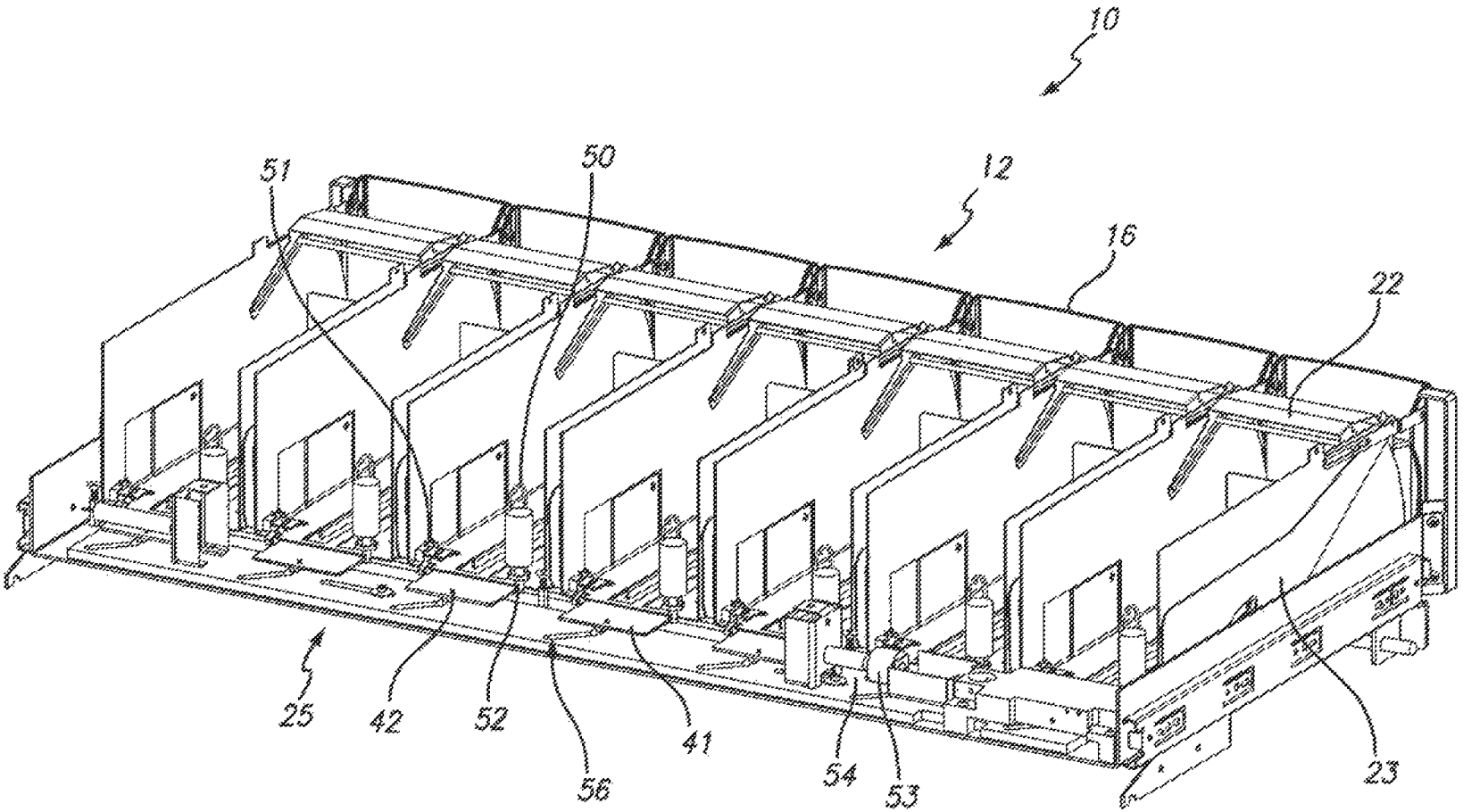
FIG. 12 is a rear perspective cross-sectional view of the inventory control system of FIG. 1.
Figure 13:
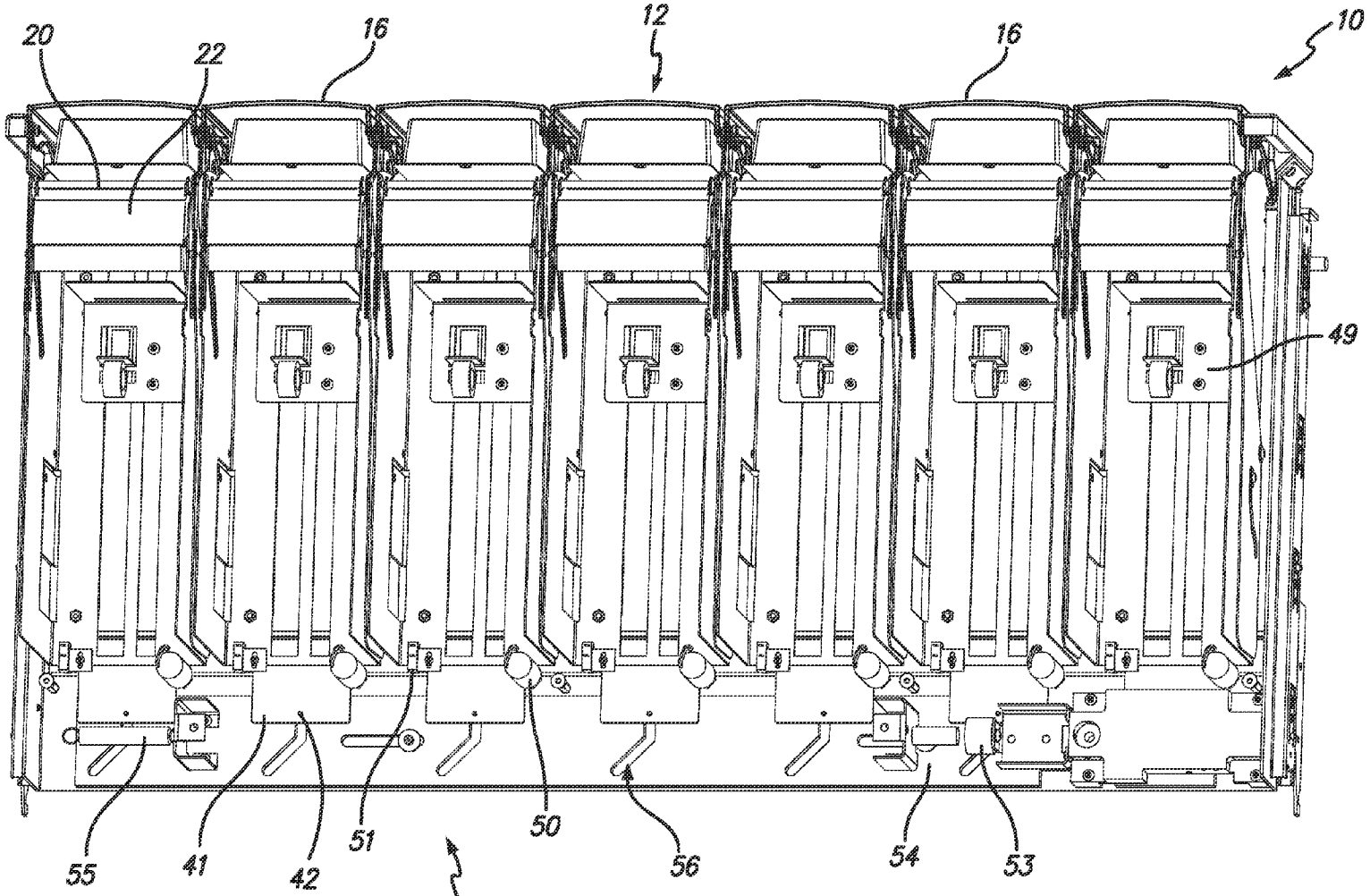
FIG. 13 is a top plan cross-sectional view of the inventory control system of FIG. 1.

Referring now to FIGS. 12 through 14, one solenoid 50 and one microswitch 51 is mounted towards the rear portion of each dispensing module 12, and microswitch 51 is engaged with sliding base 40 and is capable of being activated upon the slightest movement of sliding base 40. As such, microswitch 51 is activated upon the slightest movement of a given dispensing module 12 by attempting to open a given dispensing module 12 by pressing button 18, or otherwise by attempting to move any of the components of the dispensing module 12 (such as, for example, attempting to raise or lower blocking bar 20), because this will in turn cause attempted movement of sliding base 40 and correspondingly activate microswitch 51. Microswitch 51 is connected to a microcontroller, circuit board, or microprocessor, which are capable of operating the solenoid 50 to retract or engage a retractable pin 52 located at the lower portion of solenoid 50. When retractable pin 52 of solenoid 50 is engaged, a given dispensing module is locked in place and does not open, which is accomplished by the retractable pin 52 engaging with the rear portion of sliding base 40 of the dispensing module 12 so as to block movement of the sliding base 40. When retractable pin 52 of solenoid 50 is retracted, a given dispensing module 12 is unlocked and can be opened because the retractable pin 52 is no longer engaged with the rear portion of sliding base 40.

As shown in FIGS. 12 through 16, each separate dispensing module 12 has its own microswitch 51. Each microswitch 51 of each dispensing module 12 is connected to the microcontroller, circuit board, or microprocessor. Also as shown in FIGS. 12 through 16, each separate dispensing module 12 has its own solenoid 50 with retractable pin 52. Each solenoid 50 is connected to the microcontroller, circuit board, or microprocessor, which are capable of operating each solenoid 50 to retract or engage each retractable pin 52.

As shown in FIGS. 12 through 14, an electromagnet 53 engages with slotted bar or horizontal sliding bar 54 to hold a given dispensing module 12 in an open position when the electromagnet is energized (as shown in FIG. 14 in particular). This is accomplished by the roll pin 42, which is located on the extension tab 41 of the sliding base 40, being engaged in the slot 56 (of horizontal sliding bar 54) that corresponds to the open dispensing module 12. As can further be seen in FIG. 14, the remaining dispensing modules 12 that are in a closed stay an caused to remain in a lockout state, not only by engagement of the solenoid retractable pin 52 with the sliding base 40 of the closed dispensing modules 12, but additionally by the position of the roll pin 42 being located in a portion of slot 56 that prevents rearward movement of the corresponding closed dispensing modules 12, as shown in FIG. 14. In other words, the roll pin 42 of each of the closed dispensing modules 12 shown in FIG. 14 is located in the upper most, left most portion of the slots 56 shown in FIG. 16 (the terms "upper most" and "left most" being used in this context to refer to the orientation of slots 56 shown in FIG. 16). As such, slots 56 further lock and prevent movement of the closed dispensing modules 12 when any one of the dispensing modules 12 is in a open state.

Slot 56 can be straight, angled, or curved, and it can further comprise a groove or channel (i.e., it is not required to comprise an opening through the horizontal sliding bar 54). A portion of slot 56 can be angled (as shown), and it is contemplated and intended to be within the scope of the present invention that a portion or all of slot 56 can be angled at any angle with respect to the length of horizontal sliding bar 54, but preferably in the ranges of about 30 to 60 degrees (including but not limited to at about 45 degrees, as shown in FIG. 16, for example). The electromagnet 53 can include and encompass any type of magnet (electric or nonelectric), as well as any type of mechanical latching device known to those of skill in the art. The electromagnet 53 also may be connected to a programmable or adjustable microcontroller 70 (as is depicted in FIG. 15). Microcontroller 70 can include and encompass any adjustable or programmable timer, circuit board, or microprocessor.

When the electromagnet 53 is de-energized (through commands from the microprocessor or otherwise), spring or elastic member 55 pulls horizontal sliding bar 54 back to its original position, moving the roll pin 42 through the corresponding slot 56 and pushing the extension tab 42 and attached dispensing module base in a forward direction, thus causing an open dispensing module 12 to close (and correspondingly the horizontal blocking bar 20 to lift up through the rearward rocking action of left and right rocker arms 23). Further, because springs 63 and 64 are in a stretched or loaded state when a dispensing module 12 is in an open position, springs 63 and 64 likewise operate to pull sliding base 40 in a forward direction to raise left and right rocker arms 23, close door 16, and place dispensing module 12 into a closed state. Correspondingly, when the horizontal blocking bar 20 lifts up, the forward horizontal spring action of the constant force spring 62 of the backstop 49 incrementally advances the remaining consumer product in a forward direction (i.e., in the direction of the door 16), such that another consumer product is in a ready position for selection by another customer.

Under the configuration described above and shown in the figures above, including FIGS. 12 through 16 in particular, any number of advantageous dispensing module 12 operation configurations can be achieved. For example, the microcontroller can be programmed such that the retractable pin 52 of any given dispensing module 12 will retract upon an attempted opening of that dispensing module 12 (thus allowing that dispensing module 12 to be opened), but retractable pin 52 will remain in the engaged position for all other dispensing modules 12 until the single open dispensing module 12 is closed, thus maintaining all other dispensing modules 12 in a locked state and preventing them from being opened.

In another configuration example, the microcontroller 70 (which includes (but is not limited) to any adjustable timing device known to those of skill in the art), can be programmed to allow any one dispensing module 12 to be opened (and product removed), only a certain number of times within a certain time interval. For example, in such a configuration where the microcontroller or timing device 70 is programmed to allow a maximum of two dispensing module 12 openings within a thirty second time interval: If one dispensing module 12 is opened (and product removed) within ten seconds, and then a second dispensing module 12 (or the same dispensing module 12) is opened (and product removed) within the next ten seconds, a third dispensing module 12 cannot be opened because only twenty seconds has elapsed and all solenoid pins 52 for all dispensing modules 12 will remain in the engaged position, thus preventing any further dispensing modules 12 from being opened until after a full thirty seconds has elapsed. This configuration is possible because the microcontroller or timing device 70 is fully programmable, and also capable of detecting and counting the number of microswitch movements within a given time interval, and the microcontroller or timing device 70 is capable of operating solenoid 50 to lock or unlock any given dispensing module 12 by way of retractable pin 52. The specific time intervals and timing configuration described above is included merely by way of example (and not by way of limitation), given that the microcontroller or timing device 70 is fully programmable, and many other operational configurations, timing configurations, and timing intervals will be readily apparent to those of skill in the art in light of the disclosed invention, and each such configuration is intended to be incorporated and included herein.

In yet another embodiment of the disclosed invention, a buzzer mil/or light are included and connected to the microcontroller or device 70. As such, any number of additional operation configurations are possible. For example, if someone attempts to open more than one dispensing module 12 simultaneously, not only can the microcontroller 70 be programmed to immediately lock all dispensing modules 12, but a warning light and/or buzzer can be activated by the microcontroller as an alert feature. Similarly, if someone forcibly attempts to maintain a given dispensing module 12 in an open position longer than the programmed time interval, a warning light and/or buzzer can be activated by the microcontroller 70 as an alert feature. Alternatively or in addition, the microcontroller 70 can be programmed to detect the activation of microswitch 51 whenever someone forcibly attempts to move bar 20 or shield 22 while bar 20 and shield 22 are in the down position (i.e., during the time that a given dispensing module 12 is in the open position). Alternatively or in addition, lights (including LED lights) also can be activated during normal operation (as opposed to attempted forcible entry), to indicate normal opening/closing of dispensing modules 12. Many other similar alert features will be readily apparent to those of skill in the art in light of the disclosed invention, and each such configuration is intended to be incorporated and included herein.

It is also contemplated that wired or wireless networking capability and connectivity, as already well known in the art, be included in alternative embodiments of the disclosed invention, either as part of the microcontroller, circuit board, or microprocessor, or as a separate component of the disclosed invention. As such, any number of additional operational features and configurations will be readily apparent to those of skill in the art in light of the disclosed invention. For example, forcible entry events can be quickly communicated to store personnel or other authorities, inventory can be tracked and/or monitored, and separate automated shelving units can be interconnected and programmed in any number of advantageous manners and combinations. The system 10 can include electronics that allow for radio frequency ID and other forms of inventory control. The system 10 can operate on a electric power source, and can use a circuit board to control the timer and a vibration sensor to provide an audible alarm if the unit is aggressively handled or damaged, in which case the alarm will notify the retailer of a potential theft or vandalism.

Figure 3:
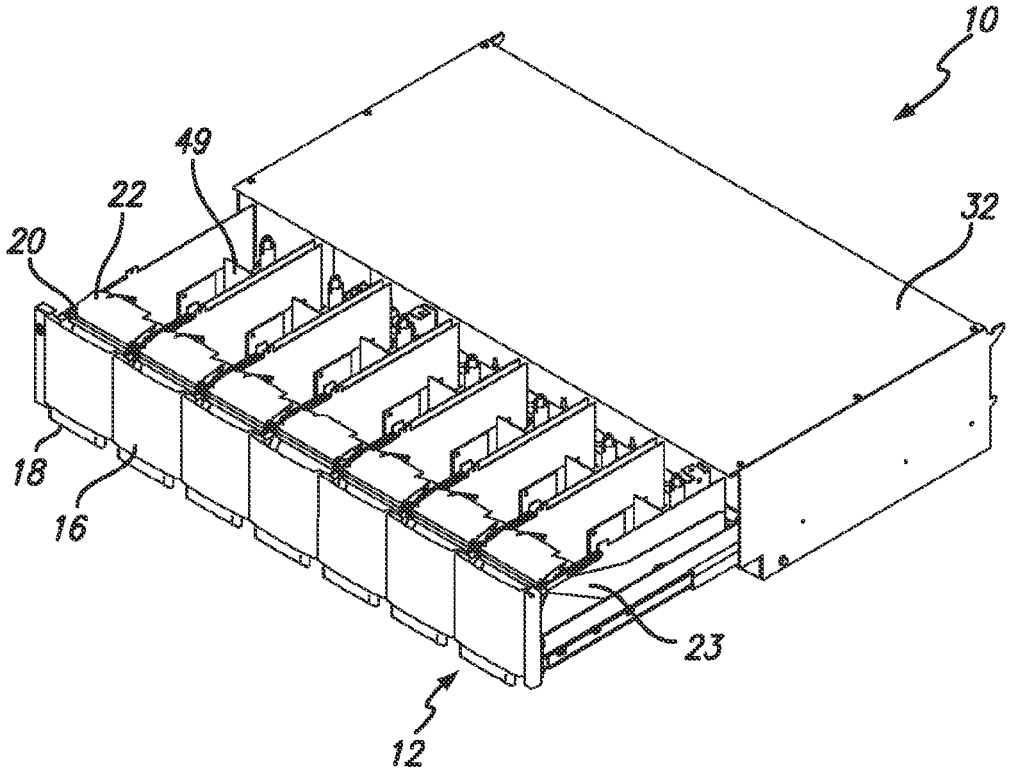
FIG. 3 is a perspective view of the inventory control system of FIG. 1 with the drawer pulled out of the housing.

The system 10 contains a manual key locking system 26 that allows the system 10 to remain locked until the retailer is ready to refill the inventory, as can be seen in FIGS. 1 and 15. As shown in FIG. 3 (and referring to the components of locking system 26 shown in FIG. 15), once the locking system 26 has been opened and unlocked, a shelf 28 (that supports each of the modular enclosures 12) slides out on drawer rails 30, like those used in kitchen cabinetry, thus allowing the inventory to be restocked with the clerk placing the new inventory behind the old inventory thus reducing the risk of spoilage.

The modular enclosures or shelving system can be modified to accommodate different types of product packaging including allergy and stomach medicines, women's toiletries, and other consumer related products. To accommodate different sized inventory, and, owing to the modular nature of the system, the total number of channels or dispensing modules can readily be reduced or increased, and the dispensing modules can readily be resized. Moreover, to the extent a given dispensing module becomes damaged, the damaged dispensing module can readily be exchanged with a new module, again, owing to the modular nature of the system.

Figure 4:
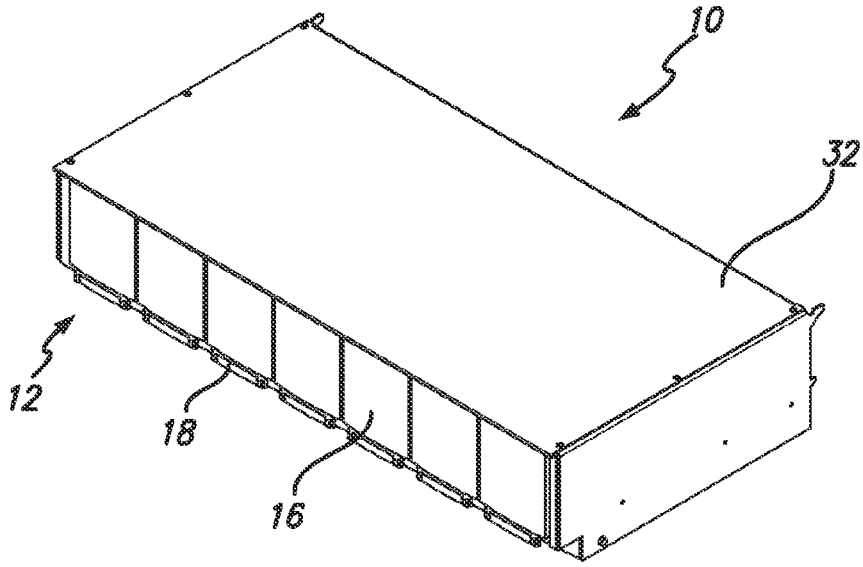
FIG. 4 is a perspective view of the inventory control system of FIG. 1.
Figure 5:
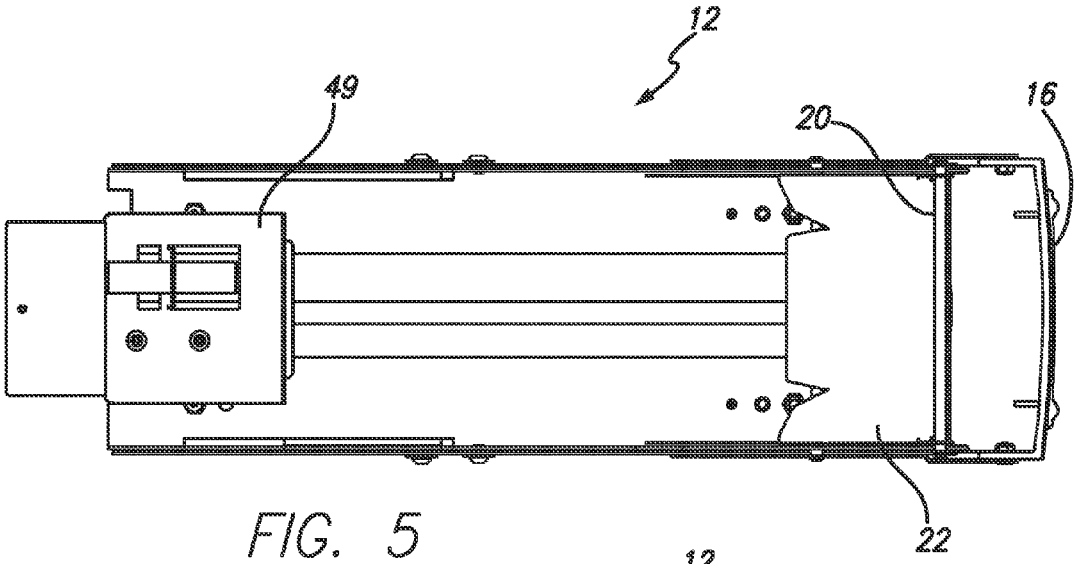
FIG. 5 is a top plan view of one of the dispensing modules of the inventory control system of FIG. 1.

As shown in FIGS. 3, 4, and 11, cover 32 is opaque; however, it is contemplated and intended to be within the scope of the present invention for cover 32 to be semi-opaque, or entirely clear and transparent, so as to allow inventory clerks to view the outstanding units within the system 10. In another embodiment, the cover 32 or other portion of the system 10 can include advertising thereon.

The particular arrangement shown in the figures and described herein is intended to be only exemplary. Various details of the invention may be changed without departing from the scope of the invention. Furthermore, the foregoing description of the preferred embodiment of the invention and best mode for practicing the invention are provided for the purpose of illustration only and not for the purpose of limitation, the invention being defined by the claims.

Unless the context clearly requires otherwise, throughout the description and the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof means any connection or coupling, either direct or indirect, between two or more elements; the coupling of connection between the elements can be physical, logical, or a combination thereof. Additionally, the words "herein," "above," "below," and words of similar import, when used in this application, shall refer to this application as a whole and not to any particular portions of this application. Where the context permits, words in the above Detailed Description of the Preferred Embodiments using the singular or plural number may also include the plural or singular number respectively. The word "or" in reference to a list of two or more items, covers all of the following interpretations of the word: any of the items in the list, all of the items in the list, and any combination of the items in the list.

The above-detailed description of embodiments of the disclosure is not intended to be exhaustive or to limit the teachings to the precise form disclosed above. While specific embodiments of and examples for the disclosure are described above for illustrative purposes, various equivalent modifications are possible within the scope of the disclosure, as those skilled in the relevant art will recognize. Further any specific numbers noted herein are only examples; alternative implementations may employ differing values or ranges.

Any patents and applications and other references that may be noted herein, including any that may be listed in accompanying filing papers, are incorporated herein by reference in their entirety. Aspects of the disclosure can be modified, if necessary, to employ the systems, functions, and concepts of the various references described above to provide yet further embodiments of the disclosure. Accordingly, although exemplary embodiments of the invention have been shown and described, it is to be understood that all the terms used herein are descriptive rather than limiting, and that many changes, modifications, and substitutions may be made by one having ordinary skill in the art without departing from the spirit and scope of the invention.

What is claimed is:

1. An inventory control system comprising:

a drawer that includes one or more dispensing modules, the one or more dispensing modules each comprising a front portion and a rear portion;

a horizontal sliding bar positioned proximate the rear portion of the one or more dispensing modules, the horizontal sliding bar comprising one or more curved slots;

a horizontal blocking bar positioned proximate the front portion of the one or more dispensing modules, the horizontal blocking bar having a left side and a right side;

wherein each of the one or more dispensing modules further comprises a dispensing module sliding base, the dispensing module sliding base comprising a front portion, a rear portion, a left side wall, and a right side wall, wherein the left side wall has an outside, and wherein the right side wall has an outside;

wherein the dispensing module sliding base further comprises an extension tab affixed proximate the rear portion of the dispensing module sliding base, the extension tab comprising a first roll pin affixed thereto, the first roll pin being positioned proximate the one or more curved slots of the horizontal sliding bar;

wherein the left side wall of the dispensing module sliding base comprises a second roll pin affixed thereto, and the right side wall of the dispensing module sliding base comprises a third roll pin affixed thereto;

wherein each of the one or more dispensing modules further comprises a left rocker arm and a right rocker arm, the left rocker arm and the right rocker arm each comprising a front portion, a rear portion, and a curved slot;

wherein the left rocker arm is positioned adjacent the outside of the left side wall of the dispensing module sliding base such that the second roll pin of the left side wall of the dispensing module passes through the curved slot of the left rocker arm;

wherein the right rocker arm is positioned adjacent the outside of the right side wall of the dispensing module sliding base such that the third roll pin of the right side wall of the dispensing module passes through the curved slot of the right rocker arm; and wherein the horizontal blocking bar is connected between the left rocker arm and the right rocker arm, the left side of the horizontal blocking bar being connected proximate the front portion of the left rocker arm, the right side of the horizontal blocking bar being connected proximate the front portion of the right rocker arm.

2. The inventory control system of claim 1 further comprising a shield affixed to the horizontal blocking bar.

3. The inventory control system of claim 2 further comprising an electromagnet affixed proximate the horizontal sliding bar.

4. The inventory control system of claim 3 further comprising an elastic member affixed proximate the dispensing module sliding base.

5. The inventory control system of claim 4, wherein the one or more slots of the horizontal sliding bar comprise a portion that is angled at between about 30 and 60degrees.

6. The inventory control system of claim 5 further comprising at least one solenoid affixed proximate the horizontal sliding bar.

7. The inventory control system of claim 6, wherein the at least one solenoid includes a retractable pin capable of retracting and extending, the retractable pin engaging with the dispensing module sliding base.

8. The inventory control system of claim 7, wherein the retraction and extension of the retractable pin is controlled by a microprocessor.

* * * * *